United States Patent [19]

Harvey

[11] 4,003,572

[45] Jan. 18, 1977

[54] HOME TENNIS PRACTICE CONTRIVANCE

[76] Inventor: Louis A. Harvey, 15107 Ilene, Detroit, Mich. 48238

[22] Filed: Apr. 28, 1975

[21] Appl. No.: 572,621

[52] U.S. Cl. ..... 273/29 A; 46/88; 273/95 A

[51] Int. Cl.[2] ..... A63B 61/00

[58] Field of Search ..... 273/26 E, 95 A, 29 A, 273/58 R, 58 C, 58 E, 67 R, 97 R; 40/212, 214; 272/78, 80, 77; 46/DIG. 1, 87, 74 A, 88

[56] References Cited

UNITED STATES PATENTS

| | | | |
|---|---|---|---|
| 700,850 | 5/1902 | Stone | 273/58 C |
| 811,546 | 2/1906 | Conroy | 272/77 |
| 2,045,972 | 6/1936 | Tompkins | 272/77 |
| 3,643,948 | 2/1972 | Coates | 46/87 X |
| 3,646,887 | 3/1972 | Stine | 46/74 A X |

FOREIGN PATENTS OR APPLICATIONS

| | | | |
|---|---|---|---|
| 375,704 | 10/1939 | Italy | 272/78 |

*Primary Examiner*—Anton O. Oechsle
*Assistant Examiner*—T. Brown
*Attorney, Agent, or Firm*—Willis Bugbee

[57] ABSTRACT

An inflatable and deflatable thin-walled bag resembling a toy balloon is adapted to be suspended from an overhead support by an elongated flexible filamentary member, such as a cord, by an attachment device, such as an adhesive strip. The length of the cord is adjustable by an adjusting device to position the bag at the desired height for the particular stroke intended to be practiced. A sharp stroke from the tennis racquet causes the air-filled bag to fly at a decreasing speed rapidly away from the racquet, but to return much more slowly because of the effect of its light weight combined with the resistance of the air upon it. Due to the effect of this rapid retardation on the return flight of the bag, the user is given sufficient time, even after making a full follow through, to enable him or her to assume the proper stance for the next practice stroke according to the height of the bag above the floor or ground level.

1 Claim, 4 Drawing Figures

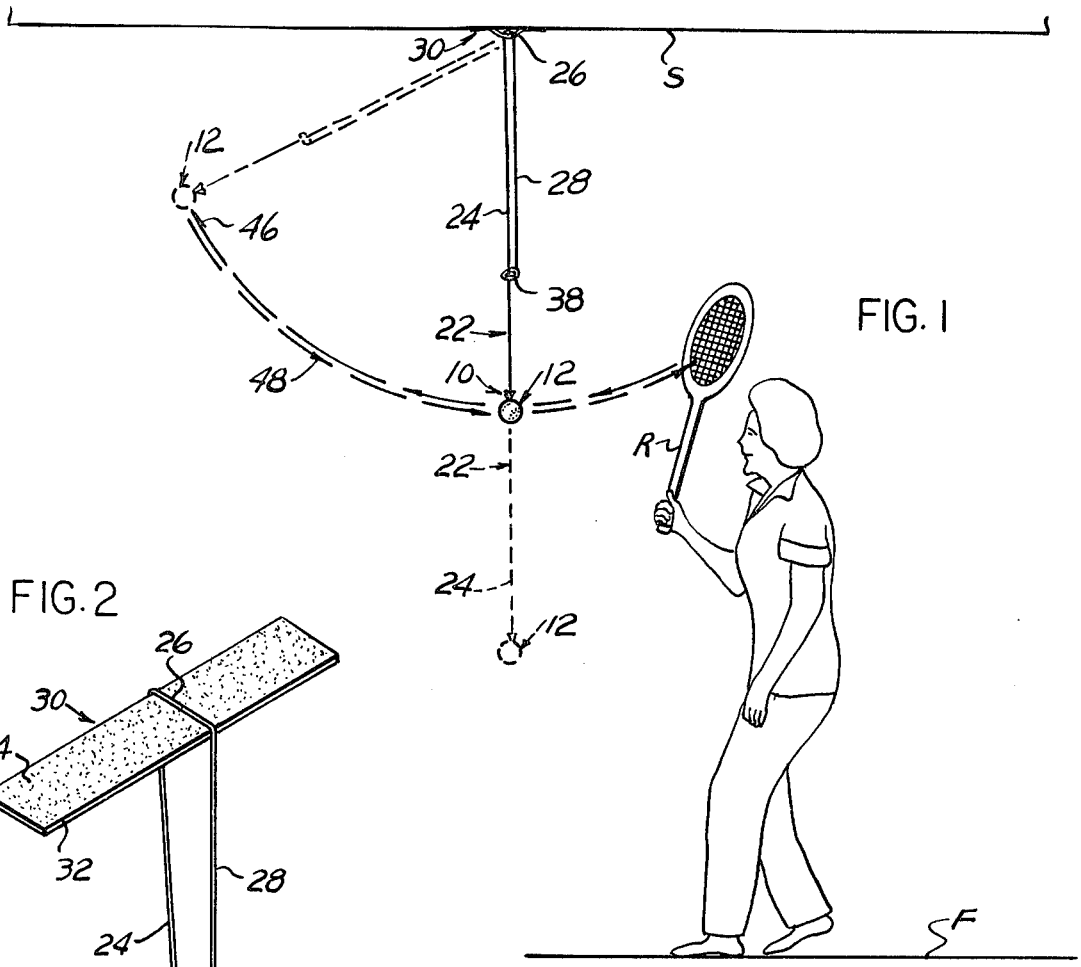
FIG. 1
FIG. 2
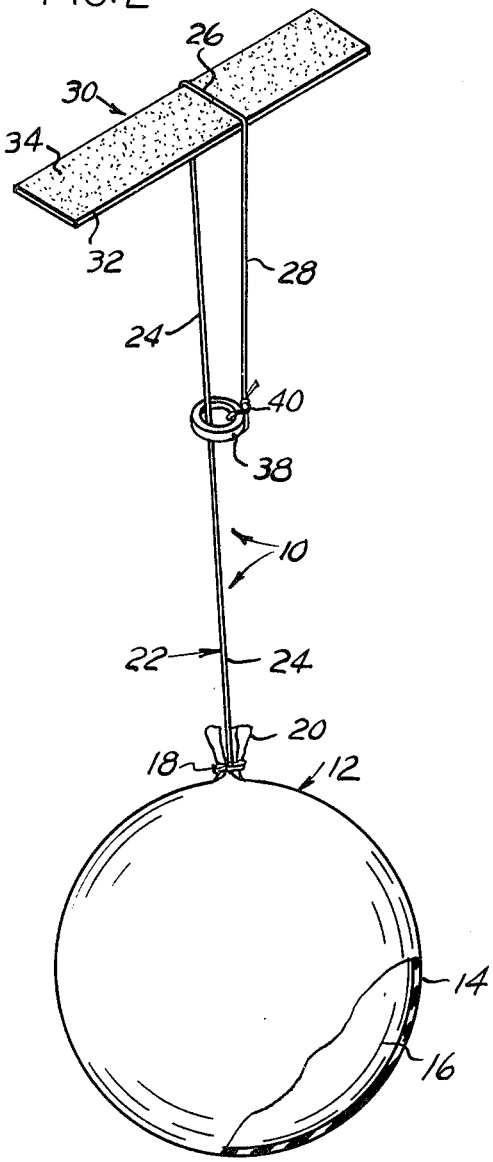
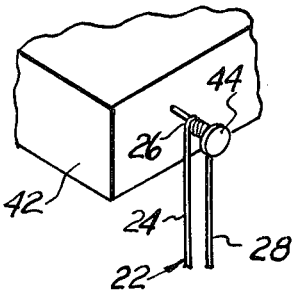
FIG. 4
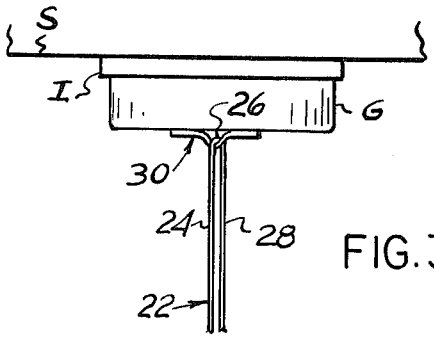
FIG. 3

HOME TENNIS PRACTICE CONTRIVANCE

BACKGROUND OF THE INVENTION

The prior art shows numerous examples of tether balls, such as tennis balls or baseballs suspended by cords from overhead supports. However, each of these prior tether balls is a comparatively heavy object which, upon being hit by a racquet or bat, is propelled at high speed through a long forward path and returns at high speed over a long return path much more rapidly than the toy-balloon-like light-weight thin-walled inflated bag of the present invention, with the result that air resistance has very little effect upon retarding the return velocity of the prior heavy tether balls. Furthermore, these prior devices, because of their heavy weights and high speed, cannot safely be used indoors in a home because of the damage they would do to objects encountered in their path. The prior art also discloses a resiliently-deformable polyurethane foam tube adapted to be suspended by a cord from an overhead support and propelled back and forth between two players equipped with bats. Experience with the present invention has shown that repeated blows upon one of the polyurethane foam objects causes the object to disintegrate quickly by its repeated sharp contacts with the taut lattice-like stringing of a tennis racquet.

SUMMARY OF THE INVENTION

The invention primarily resides in the provision of an elastomeric thin-walled light-weight inflatable and deflatable bag, like a toy balloon, suspended by an elongated flexible filamentary member, such as a cord, from an overhead support, such that the speeds of the forward and return flights of the bag are so greatly retarded by the air resistance that it almost halts when it reaches the player. The toy-ballon-like thin-walled deflated bag is thin and flat, hence is easily packed, shipped, stored and carried by the player in a compact low-cost flat container, such as an envelope, and is quickly and easily inflated by the mouth of the player upon reaching home or other practice location, where it is to be used. Advertising matter can also be imprinted upon the bag.

In the drawing,

FIG. 1 is a diagrammatic side elevation of an inflated suspended inflatable and deflatable bag for home tennis practice, showing the contrivance in use, with its stationary vertical position in solid lines and its propelled forward path position in dotted lines and with the lowered position of the bag also in dotted lines;

FIG. 2 is an enlarged perspective view of the contrivance of FIG. 1, showing the cord length adjustment means and the adhesive tape attachment means with the central portion of the cord broken away to conserve space;

FIG. 3 is a side elevation of the upper portion of the cord attached to a ceiling light fixture by the adhesive tape shown in FIG. 2; and FIG. 4 is a perspective view showing the attachment of the cord to a fastener inserted and secured in an overhead object.

Referring to the drawing in detail, FIGS. 1 and 2 show an inflatable and deflatable suspended home tennis practice contrivance, generally designated 10, as including a toy-balloon-like inflatable and deflatable spheroidal bag 12 with a thin wall 14 of elastomeric material such as rubber or the like which is resilient and expansible. In size and appearance the bag 12 resembles a conventional tennis ball but has a wall thickness similar to that of a toy balloon. The chamber 16 within the bag 12 is inflated with air which is held therein by a constriction 18 around a tubular inflation neck portion 20. This constriction 18 conveniently consists of a tie member, such as a constriction portion constituting the lower end portion 18 of an elongated filamentary suspension member 22 such as a cord 22 which is secured lightly around the inflation neck 20.

The cord 22 may be of any suitable substantially inextensible form and material, such as a cotton or other fabric string or woven cord. The cord 22 has a main suspension portion 24 joined by an intermediate bend or pivot portion 26 to a reversly directed surplus portion 28, the intermediate bend or pivot portion 26 being looped over an attachment device 30. Such an attachment device 30 may conveniently consist of a short strip of adhesive tape consisting of a flexible backing strip 32 of flexible fabric, synthetic plastic or the like covered with an adhesive layer 34.

At its reversely directed surplus end 36 the upper portion 28 of the cord 22 is tied or otherwise attached to a cord length adjuster in the form of a cord-retaining slider or slip ring 38 having an aperture 40 therein through which the main suspension position 24 of the cord 22 passes, and to which it is joined by the intermediate bent or pivot portion 26.

In the modification shown in FIG. 4, the home practice tennis contrivance 10 remains the same, except that an overhead support 42, such as a ceiling beam, is provided with a fastener 44 over which the intermediate bend or pivot portion 26 of the suspension cord 22 is wound around. This replaces the adhesive attachment member 30.

In the use of the invention, the user or player inflates the bag 12 and twists and ties the neck 20 in an overhand knot 46 and ties the end 18 of the cord 22 or with an independent length of cord around the inflation neck 20 to retain the air within the chamber 16. He then adjusts the length of the main portion 24 of the suspension cord 22 to place the inflated bag 12 at the desired height by the means of the cord length adjuster 38 thereby fixing the location of the intermediate bend or pivot portion 26, whereupon the adhesive strip or attachment member 30 is placed against the intermediate bend or pivot portion 26 to temporarily fix the location of the latter. The adhesive strip 30 is then pressed against an overhead support S, such as the ceiling or beam shown in FIG. 1, or hooked over a fastener 44 as in FIG. 4, or pressed against an overhead globe G of an illuminating fixture I which depends from or is attached to the overhead support S. The player than proceeds to practice in a manner similar to that which he would do in a tennis game, using a conventional tennis racquet R to bat the inflated bag 12 as shown in FIG. 1. A sharp stroke of the tennis racquet R by the player causes the bag 12 to be propelled rapidly upward in an arcuate forward path, as shown by the arrow 46 in FIG. 1. On its return flight, however, the bag 12, due to its light weight and the decelerating effect of the air resistance upon it, is sharply retarded along its return path indicated by the arrow 48, so that when it reaches its vertical solid line position (FIG. 1) it is moving very slowly or halts. This gives the player the opportunity to assume all of the correct stances and movements which he or she would assume or execute in an actual tennis game, depending upon the height of the bag 12 relatively to the floor or ground level F.

To practice plays simulating the return stroke of a tennis ball, near the floor or ground level F, the player lengthens the cord 22 by disengaging the intermediate bend or pivot portion 26 from the adhesive fastener 30 (FIG. 2) or from the fastener 44 (FIG. 4), sliding the slider 38 upward along the main suspension cord portion 24, thereby lengthening the main suspension portion 24 and shortening the reversely directed surplus portion 28, as indicated by the vertical dotted lines in FIG. 1. With the inflated bag 12 thus placed at the desired height above the ground or floor level F, the player resumes practice. When hit with a sharp blow of the racquet R, the bag 12 moves rapidly upward on its forward flight but seems to be almost floating on the air during its return flight, so effective in retarding its flight is the combination of its light weight with air resistance.

Even if the bag 12 strikes walls or ceilings, it does so silently without any damage to the part struck and without causing any reverberation in the room. Use of this device 10 permits a wide variety of strokes to be practiced, such as full swing, chop strokes, follow-through strokes, lobs, back-hand strokes, and the like. The sound of the light-weight and resilient toy-balloon-like bag 12 when struck is so light that it does not disturb persons elsewhere in the building or even in the same room. The adhesive attachment device 30 may be reused repeatedly, especially when the adhesive layer 34 is a pressure-sensitive adhesive. Such pressure-sensitive adhesive tape is conventional and is sold on the open market. The bag 12, when deflated, is of limply-drooping elongated shape, due to the thinness of the elastomeric material of which it is composed. A suitable thickness, in rubber, has been found to be 0.008 to 0.012 inches, with a durometer test of 28 to 30.

The use of the home tennis practice contrivance 10 has proved to be beneficial both to the mind and to the body and aids the user in reducing excess weight. Its low cost enables it to be distributed as a give-away article in connection with the promotion of tennis-related business and recreation, both at home and in schools. It is also a valuable aid to assist and amplify the teaching of a tennis instructor.

I claim:

1. A home-tennis practice contrivance comprising an elongated flexible substantially inextensible filamentary suspension member having a main suspension portion with a pivot portion at its upper end adapted to be connected to an overhead support and having a reversely-directed surplus portion depending from said pivot portion, an inflatable and deflatable toy-balloon-like bag of elastomeric material having a tubular inflation neck portion projecting upward therefrom and adapted to be constricted in air-retaining relationship to said bag and connected to the lower end of said main suspension portion of said suspension member, said bag when inflated being of spheroidal shape and of substantially the size of a conventional tennis ball, said bag when deflated being of limply-drooping vertically-elongated shape, said bag in response to impact with a tennis racquet travelling upon a forward flight at relatively high speed and upon a return flight at a greatly retarded speed in response to the decelerating effect of air resistance upon the bag. ;

and an attachment device connected to said pivot portion of said suspension member and having an adhesive layer thereon adapted to be adhesively secured to the overhead support, said reversely-directed surplus portion having a suspension member length adjuster consisting of a cord-retaining slider containing an aperture and connected to the lower end of said surplus portion and slidably engaging and encircling said main suspension portion.

* * * * *